US005753877A

United States Patent [19]

Hartzel et al.

[11] Patent Number: 5,753,877

[45] Date of Patent: May 19, 1998

[54] CIRCUIT BREAKER TERMINAL TUBULATOR PROTECTION ASSEMBLY FOR DIVERTING DISCHARGED IONIZED GASSES

[75] Inventors: Ronald D. Hartzel, Summit; Robert J. Tedesco, Coraopolis; William D. Munsch, Franklin Park; Michael J. Erb, Franklin, all of Pa.

[73] Assignee: Eaton Corporation, Cleveland, Ohio

[21] Appl. No.: 602,538

[22] Filed: Feb. 20, 1996

[51] Int. Cl.[6] ..... H01H 9/30; H01H 33/04

[52] U.S. Cl. ..... 218/157; 218/158

[58] Field of Search ..... 200/304–306; 218/22, 34–41, 81, 148–151, 155–158

[56] References Cited

U.S. PATENT DOCUMENTS

| | | | |
|---|---|---|---|
| 3,555,224 | 1/1971 | Fried et al. | 218/34 |
| 3,564,176 | 2/1971 | Fechant | 218/149 |
| 3,728,503 | 4/1973 | Clausing et al. | 218/149 |
| 4,620,076 | 10/1986 | Mrenna et al. | 200/304 |
| 4,639,564 | 1/1987 | Grunert et al. | 218/156 |
| 4,650,940 | 3/1987 | Grunert et al. | 218/155 |
| 4,733,031 | 3/1988 | Belbel et al. | 218/1 |
| 4,963,849 | 10/1990 | Kowalczyk et al. | 218/35 X |
| 5,166,651 | 11/1992 | Jacobs et al. | 218/155 |
| 5,493,092 | 2/1996 | Rowe | 218/156 |

*Primary Examiner*—J. R. Scott
*Attorney, Agent, or Firm*—Martin J. Moran

[57] ABSTRACT

An electrically insulated turbulator for use in an electrical device for automatically interrupting an overload current is a one-piece molded assembly with an arcuate portion arranged around a terminal screw and a downwardly turned flange for shielding the terminal from the ionized gases in the arc chute. The arcuate portion has several fins and spaced-apart planar portions, both of which are located in the path of the ionized gases. The planar portions have surfaces which cooperate with the fins to create a turbulent flow pattern to decrease the length of the gas flow, and thereby optimize the cooling effect on the gases and for directing the gas flow in a desired direction. The turbulator is preferably made of a gassing material which contributes to the deionizing of the gasses, which lessens the buildup of gas pressure. It also preferably has a blowout membrane in order to limit the back pressure in the device.

20 Claims, 4 Drawing Sheets

CIRCUIT BREAKER TERMINAL TUBULATOR PROTECTION ASSEMBLY FOR DIVERTING DISCHARGED IONIZED GASSES

BACKGROUND OF THE INVENTION

1. Field of the Invention

This invention relates to an electrical device for automatically interrupting an overload current, such as a circuit breaker or a motor circuit protector, and more particularly, to an electrically insulating shield around the terminals in the housing of the electrical device.

2. Description of the Prior Art

When contacts of an overload current interrupter device are opened, an arc is usually created which is accompanied by the generation of ionized gases. Where wiring terminals are in close proximity to the vents for exhausting the gases, the problem becomes especially acute. The ionized arc gases may contain particles which are electrically conductive and result in flashover of the arc to nearby terminals thereby causing a phase-to-phase electrical failure between the terminals or a phase-to-ground electrical failure to any metallic surface within the enclosure in which the current interrupter device is mounted. For this reason, an arc chute generally provided in an overload current interrupter device is ineffective, and therefore, the need for a shield around the terminal, particularly the line terminal in the housing for the current interrupting device.

Several types of shields are available for molded case circuit breakers, such as those disclosed in U.S. Pat. Nos. 4,620,076; 4,639,564; and 4,650,940.

U.S. Pat. No. 4,620,076 discloses a shield comprising upwardly and downwardly extending flanges and an aperture for receiving a sleeve which surrounds a screw of a clamp or threaded collar of a terminal. The downwardly turning flange extends between the clamp and the arc chute.

U.S. Pat. No. 4,639,564 discloses several embodiments for a tubular wall in a cover of a circuit breaker which surrounds a terminal screw. Some embodiments show a tubular wall with a biased end face with the lower end of the face being disposed between the screw and the opening in a wall of the cover. This biased end face provides a cooling effect caused by siphoning or inflow of air from the top of the tubular wall downwardly through the tubular wall and around the terminal screw from where it exhausts into the atmosphere through an outlet.

U.S. Pat. No. 4,650,940 discloses a baffle member generally in an S-shaped configuration and having a flap which is disposed over the inner side of an opening adjacent to a steel cover plate so that the ionized gases are deflected by the flap toward an opening in communication with the atmosphere.

Some disadvantages with the prior art disclosed in these patents are that the terminal screw is exposed to the exhaust gases or if the terminal screw is shielded from the exhaust gases more than one element is needed to both protect the terminal screw and to divide the arc chute from the terminal. A further disadvantage is that, even though U.S. Pat. No. 4,639,564 teaches the cooling of the gases by siphoning fresh air and mixing it with hot gases, the exhaust gases still remain relatively hot, creating an unsafe environment. A still further disadvantage of the prior art is that the exhaust gases exit the circuit breaker in a relatively straight path without control of the flow path.

There is a need, therefore, in the art to provide not only a shield for the terminal screw and a divider between the arc chute from the terminal compartment, but to optimally cool the exhaust gases and to control the direction of the path of travel of the gases exiting from the device.

SUMMARY OF THE INVENTION

The present invention has met the above-described needs. The present invention provides, in an electrical device for automatically interrupting an overload current, an electrically insulated turbulator which is of molded or fabricated construction and having an arcuate portion which surrounds and shields the terminal screw from the ionized gases and a downwardly extending flange which separates the arc chute from the terminal compartment. The arcuate portion surrounding the terminal screw has several spaced-apart planar portions and offset fins which are positioned relative to the planar portions to create turbulence in selected areas and to direct the path of travel of the exhaust gases in a predetermined direction. Several embodiments of the present invention provide for different offset positions of the fins relative to the planar portions resulting in different turbulent patterns and different directions for the exiting gas flow. The fins and planar portions increase the turbulence resulting in an increase in the expansion and, thus, the optimum cooling of the exhaust gases. The turbulator also has a blowout membrane to limit the back pressure in the device, particularly in a molded case circuit breaker. Preferably, the turbulator is made of a gassing material, such as aluminum trihydrate in order to aid in arc quenching.

It is therefore an object of the present invention to provide in a device where ionized gases develop upon interruption of an overload current a means which protects the terminal screw, separates the terminal compartment from the ionized gases, increases the turbulence of the exiting ionized gases, and therefore optimizes the cooling effect of the exiting gases, and predetermines the path of travel of the exiting gases.

It is a further object of the present invention to provide in a device in which ionized gases are developed when an overload current occurs, a turbulator which optimizes turbulence in the ionized gas flow thereby decreasing the length of the path of travel of the ionized gases and thus optimizing the cooling thereof.

It is an additional object of the present invention to provide such a turbulator which reduces the likelihood of arcing within the current interrupting device.

These and other objects of the present invention will be more fully understood and appreciated from the following descriptions of the present invention upon reference to the illustrations appended hereto.

DETAILED DESCRIPTION OF THE PREFERRED EMBODIMENT

The present invention, preferably, is used in an electrical device which automatically interrupts an overload current, such as a circuit breaker or a motor circuit protector. However, for purposes of illustration, the present invention will be explained within the parameters of a molded case circuit breaker.

Figure 1:
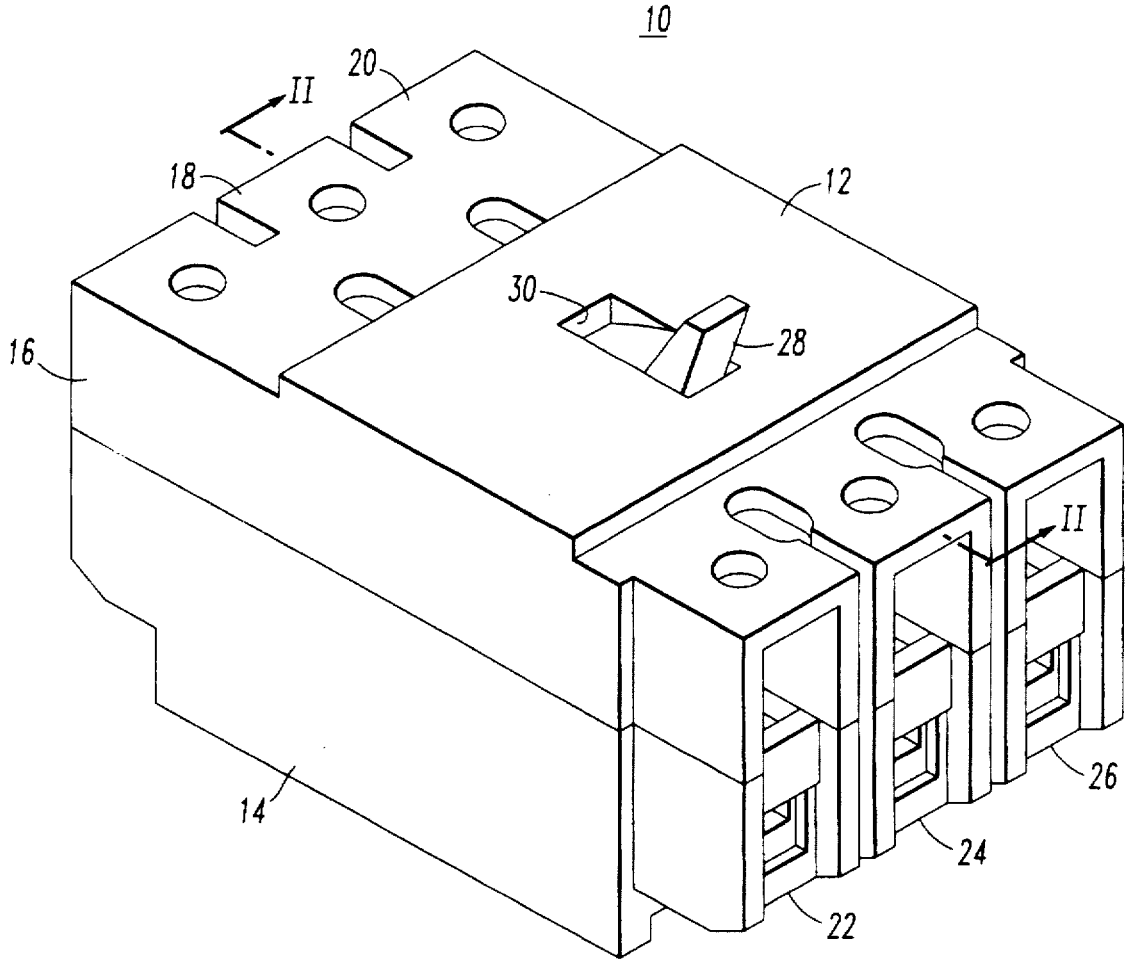
FIG. 1 is an isometric view of a three-phase molded case circuit breaker.

In FIG. 1, a three-phase molded case circuit breaker is generally indicated at 10 and includes an electrically insulated housing comprising molded cover 12 and a similarly molded base 14. For the three phases, three line terminals are provided as indicated at numerals 16, 18, and 20, and three load terminals are provided as indicated at numerals 22, 24, and 26, where load terminal 22 is related to line terminal 16, load terminal 24 is related to line terminal 18, and load terminal 26 is related to line terminal 20.

A handle 28 for manually opening and closing the circuit breaker extends through opening 30 in cover 12. An indicator (not shown) alongside handle 28 provides a visual indication that circuit breaker 10 is in a tripped position. When it is in another position, the indicator is hidden beneath a portion of the front cover 12.

Figure 2:
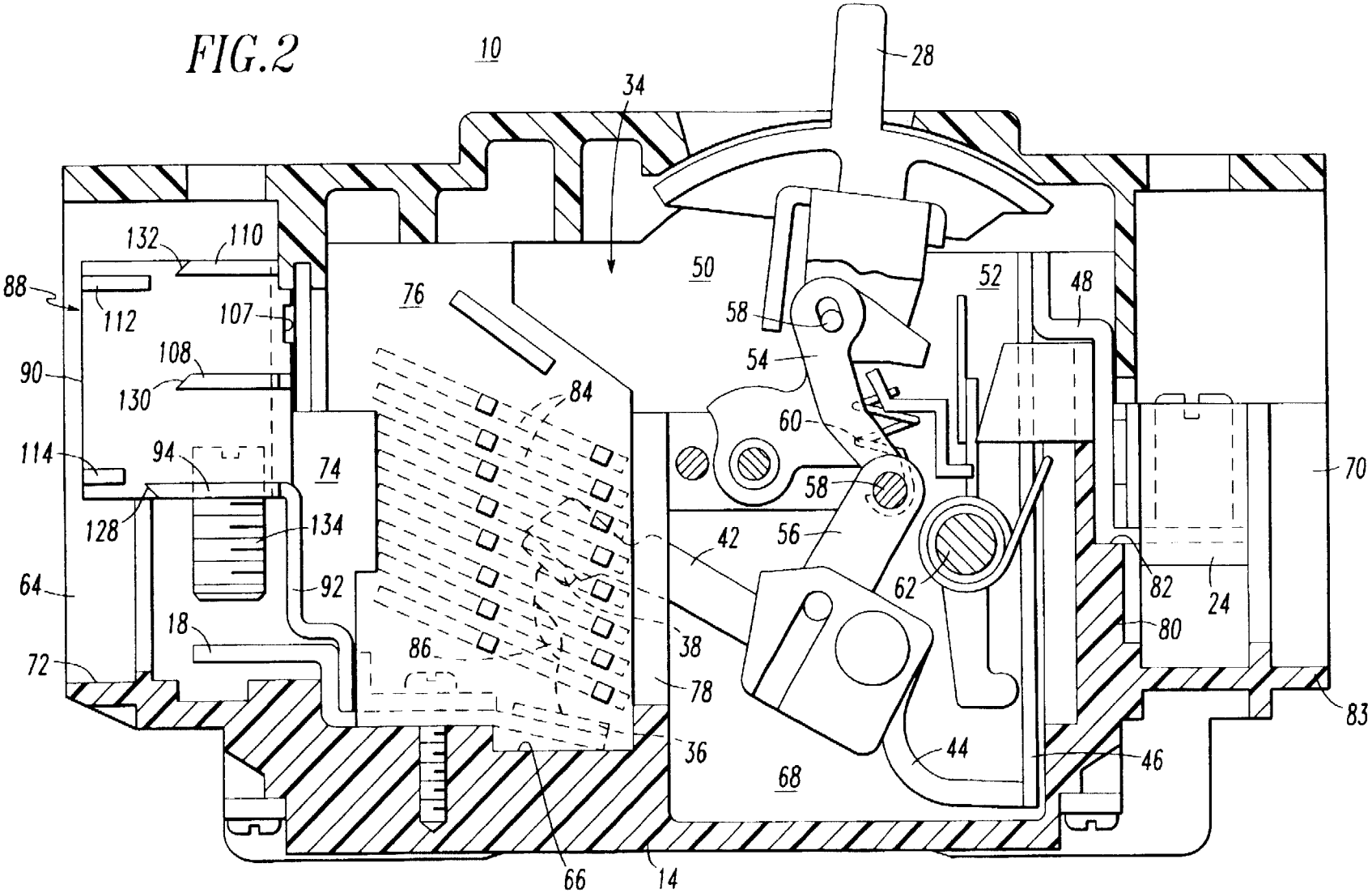
FIG. 2 is a generally vertical sectional view taken along lines II—II of FIG. 1 showing the mechanism in the off position and the turbulator of the present invention installed in the circuit breaker.

As shown in FIG. 2, a circuit breaker mechanism 34 is provided within the molded case for interconnection between line terminal 18 and load terminal 24. Circuit breaker mechanism 34 includes a fixed electrical contact 36 and a movable contact 38. Fixed contact 36 is welded on the line terminal 18, and movable contact 38 is mounted on contact arm 42 and is movably operable relative to contact 36 depending on the status of circuit breaker mechanism 34. The electric circuit through circuit breaker 10 extends from line terminal 18 to load terminal 24 by way of the contacts 36,38, the contact arm 42, a flexible conductor or shunt 44, a bi-metal element 46, when contacts 36 and 38 are closed.

Circuit breaker mechanism 34 includes a support assembly 50 and an operating mechanism 52 comprising a center toggle linkage including links 54,56 which are pivotally connected at pivot pin 58, to which coil spring 60 is connected, and a trip bar 62 which is activated by bi-metal element 46.

As is well known in the art, each of the three poles of circuit breaker 10 constitutes a chamber having several compartments as indicated at numerals 64, 66, 68, and 70 in FIG. 2.

Still referring to FIG. 2, terminal 18 is disposed in compartment 64 between an access opening 72 and a partition 74. An arc chute 76 is disposed between partitions 74 and 78 of compartment 66. Operating mechanism 52 is disposed between partitions 78 and 80 of compartment 68, and load terminal 24 is located between partition 80 and an access opening 82. Thus, the several parts 18, 76, 52, and 24 are disposed respectively in separate compartments 64, 66, 68, and 70, and each partition 74, 78, and 80 is provided with openings (not numbered) for interconnecting the several parts discussed hereinabove in a manner well known to those skilled in the art.

In the usual manner, arc chute 76 includes a plurality of spaced deionization plates 84 which surround the movable contact 38 as it moves away from fixed contact 36 in order to extinguish an arc indicated at numeral 86 extending there between.

Figure 4:
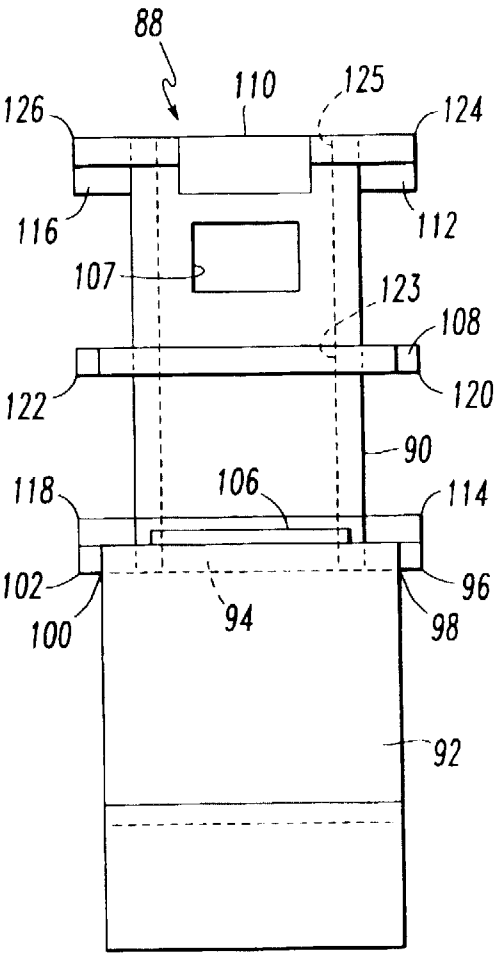
FIG. 4 is a rear elevational view of the turbulator of FIG. 3 and taken along lines IV—IV of FIG. 3.
Figure 3:
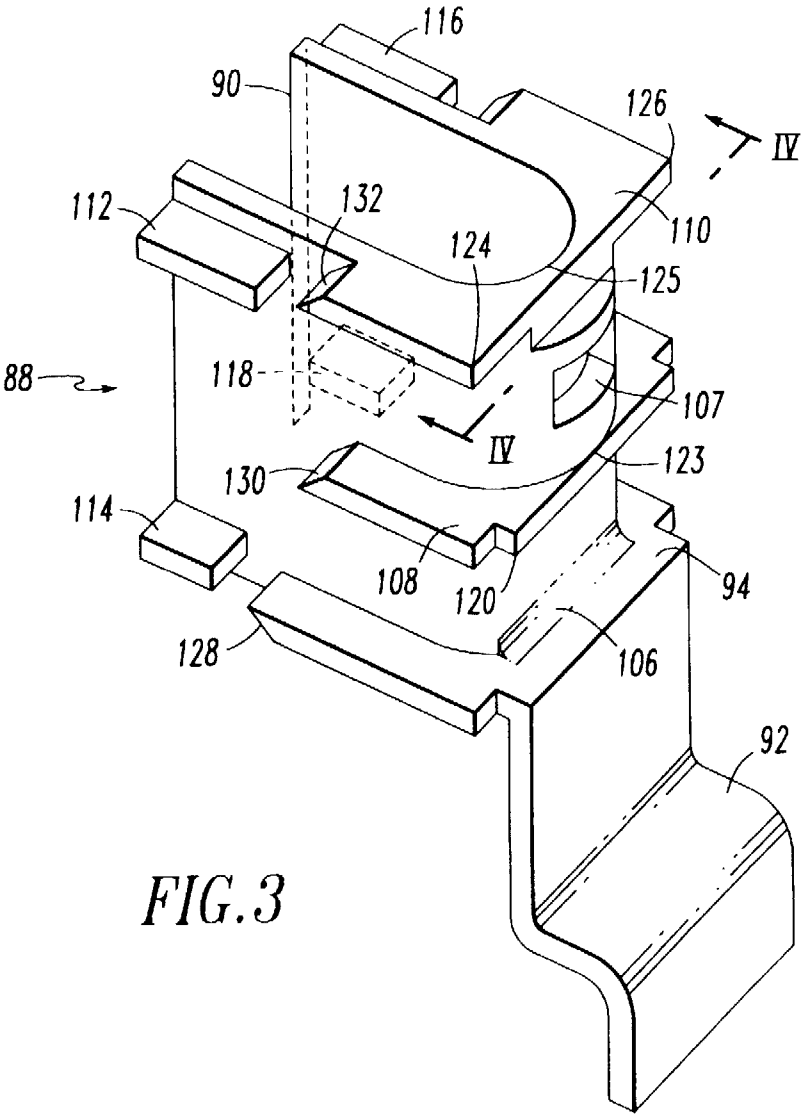
FIG. 3 is an isometric view of the turbulator of the present invention.

In accordance with the present invention, a turbulator 88 of FIGS. 3 and 4 is disposed in compartment 64 of FIG. 2 between arc chute 76 and terminal 18. Turbulator 88 is comprised of an electrically insulating gassing, or non gassing or deionizing material such as a fiber composition, for example, vulcanized fiber sheet (otherwise known as fishpaper) or aluminum trihydrate filler. Turbulator 88 has the configuration as shown in FIGS. 3 and 4.

With particular reference to these FIGS. 3 and 4, turbulator 88 comprises an upper arcuate portion or oval 90 in the form of a U-shaped member and a downwardly extending flange portion 92 in the form of an S-shaped member. The transition area between arcuate portion 90 and flange 92 provides a first planar portion 94 having squared outer peripheral edges indicated at numerals 96, 98, 100, 102 and an inward arcuate recess 104 encircling arcuate portion 90. As best shown in FIG. 4, a chamfer 106 is formed in arcuate portion 90 for strength. Above chamfer 106 is a blowout membrane 107 which is a weak spot in the wall of arcuate portion 90 and which is thinner than the remaining wall of arcuate portion 90. This blowout member is provided in order to limit the back pressure in the device. If the pressure in the case increases drastically and requires a larger opening to escape than exists, then the blowout member 107 will rupture and permit the gas to exit the breaker in a predetermined location. This prevents breaker case rupture.

Arcuate portion 90 also comprises spaced-apart second and third planar portions 108,110, respectively, and fins 112, 114, 116, and 118, which are offset or staggered relative to planar portions 94, 108, and 110. As is shown best in FIG. 4, second and third planar portions 108, 110 have squared outer peripheral edges as indicated at numerals 120, 122 and 124, 126, respectively, and an inward arcuate recess portion 123,125, respectively. For arcuate recess 123, second planar portion 108 encircles arcuate portion 90 and arcuate recess 125 for third planar portion 110 is part of arcuate portion 90. As best shown in FIG. 3, planar portions 94, 108, and 110 extend horizontally about midway along the wall of arcuate portion 90 and terminate with a biased edge as indicated at 128, 130, and 132. Biased edges 130 and 132 for planar portions 108,110, respectively, are angled in the same direction toward fins 112 and 114, and biased edge 128 for planar portion 94 is angled in an opposite direction relative to edges 130 and 132 away from fins 112,114. These angled surfaces make it easier for the part to be assembled into the breaker. It is to be appreciated from FIG. 5 that the opposite side of planar portions 94, 108, and 110 is the same as that shown in FIG. 3 relative to fins 116 and 118.

As shown in FIG. 2, the turbulator 88 is disposed in compartment 64 near a clamp 136 and with S-shaped flange 92 extending downwardly between clamp 136 and arc chute 76 and arcuate portion 90 around a terminal screw 134. Flange 92 is disposed over line terminal 18 to divide compartments 64 and 66, with planar portions 94, 108, and 110 extending the width of compartment 64. In view of this particular construction of turbulator 88 and its arrangement in compartment 64, the ionized gases generated upon the opening of contacts 36 and 38 due to arcing 86 are forced to flow between planar portions 94, 108, and 110 in a pattern indicated by the arrows in FIG. 5, more about which will be discussed hereinbelow.

Figure 5:
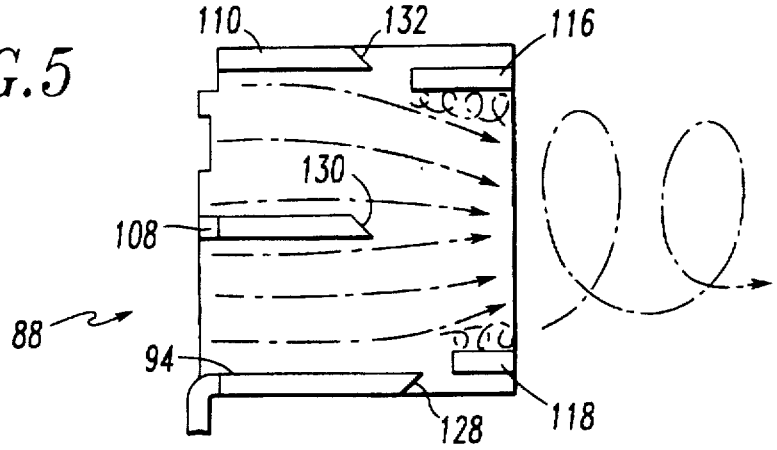
FIG. 5 is a fragmentary view of a side of the turbulator of FIG. 3 and schematically showing the path of travel for the gas flow.

Inasmuch as the gases and other particles produced during arcing 86 of the opening of contacts 36,38 are conducive to arc flashover between contact 38 and terminal screw 134, clamp 136, and contact 36, the turbulator 88 insulates the line terminal 18 from the ionized gases, prevents flashover, and forces the gases to exit from opening 72 of line terminal 18 in the manner shown in FIG. 5, between planar portions 94, 108 and 110 and then between fins 112 and 114. As shown by the curls, the location of fins 112 and 114 relative to planar portions 94, 108, 110 creates turbulent areas for the gases upon the path of travel out of opening 72 and causes the gas to flow in a relatively straight direction out of opening 72, in a swirling motion.

Figure 6:
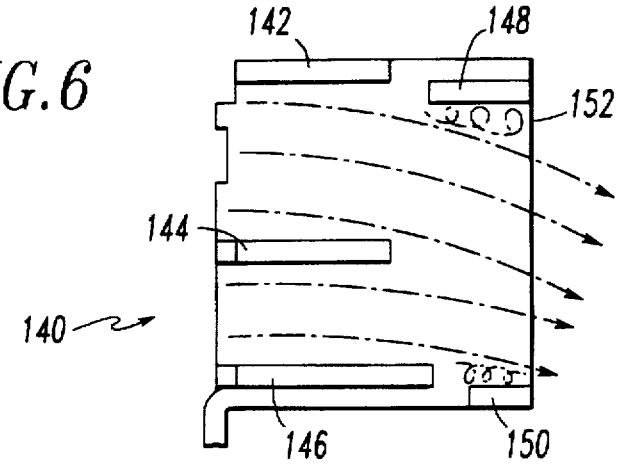
FIG. 6 is a fragmentary view of a side of a turbulator and showing schematically the path of travel for the gas flow of a second embodiment of the present invention.
Figure 7:
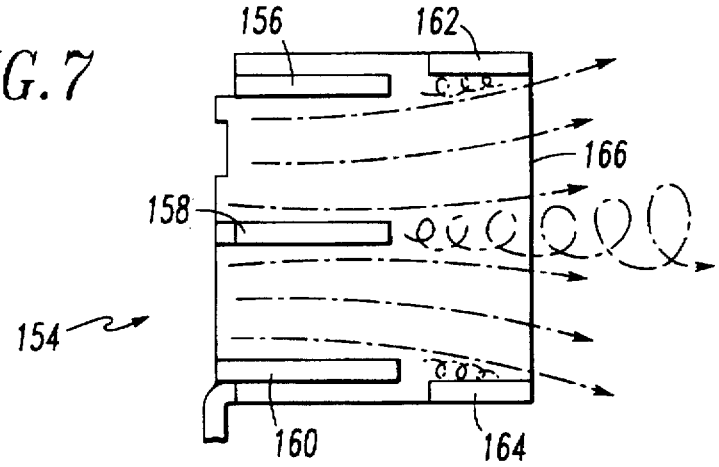
FIG. 7 is a fragmentary view of a side of a turbulator and showing schematically the path of travel for the gas flow of a third embodiment of the present invention.

FIGS. 6 and 7 show a second and third embodiment, respectively, for the turbulator of the present invention. With particular reference to FIG. 6, a turbulator 140 has planar portions 142, 144, 146 and fins 148, 150 which are positioned in a pattern along an arcuate portion 152 and relative to each other as shown in FIG. 6. This arrangement of planar portions 142, 144, 146 and fins 148, 150 creates turbulent areas as indicated by the curls for the gases upon their path of travel and causes the gas flow to turn downwardly as shown by the arrows in FIG. 6. This path flow results in that planar portion 146 is higher and fin 150 is lower than planar portion 94 and fin 114, respectively, of FIG. 5.

Even though not shown, it is to be understood that the other side of turbulator 140 is a mirror image to that shown in FIG. 6 and that the gases flow around the arcuate portion 152 of turbulator 140 in a similar manner.

With particular reference to FIG. 7, a turbulator 154 has planar portions 156, 158, 160 and fins 162, 164 which are positioned in a pattern along an arcuate portion 166 and relative to each other as shown in FIG. 7. This arrangement of planar portions 156, 158, 160 and fins 162, 164 on arcuate portion 166 creates turbulent areas as indicated by the curls for the gases upon their path of travel and causes the gas flow to turn upwardly and downwardly as shown by the arrows in FIG. 7. This path flow results in that the upper planar portion 156 is lower and fin 162 is higher than planar portion 142 and fin 148, respectively, of FIG. 6.

Even though not shown, it is to be appreciated that the other side of turbulator 154 is a mirror image to that shown in FIG. 7 and that the gases flow around arcuate portion 166 of turbulator 154 in a similar manner.

Depending on the desired or required gas flow pattern for a particular industrial application, turbulator 88, 140, or 154 may be used in the circuit breaker 10 of FIGS. 1 and 2. For instance, the circuit breaker 10 may be enclosed in a metal box about 12 inches wide, 6 inches high, and 4 inches deep. The objectives of the turbulator arc to deflect the exiting gasses away from the closest metal surfaces and to create as much turbulence as possible to cool the exiting gases. If the exiting gases are not cool before they come in contact with a metal surface, it is possible for an arc to establish itself from the metal surface to the arc chamber of the breaker.

The turbulent areas of turbulators 88, 140 and 154 create a turbulent flow which, in effect, increases the drag on the gas molecules to decrease the path length of the ionized gases and thus resulting in an increase in the cooling effect in the gases exiting the circuit breaker.

The thickness of the several planar portions and fins of turbulators 88, 140, and 154 are preferably about the same. For example, for an overall length of about 1.50 inches for each turbulator 88, 140, 154, the thickness of the planar portions and fins are about 0.50 inches.

The spacing and number of fins employed affect the degrees of turbulence and back pressure: more fins, more turbulence; more space, less back pressure.

In conclusion, the turbulator 88, 140, and 154 of the present invention shields the terminal screw 134 from the arc blast to eliminate the electrical flashover during an overload circuit or a short circuit interruption and deflects the ionized gases around the terminal screw and out of the line terminal opening 72 in a desired gas flow pattern, with an increased turbulence, which exits either in a straight direction of FIG. 5, in a downward direction of FIG. 6, or in an upward and a downward direction of FIG. 7.

The present invention replaces the several individual components of the prior art for protecting the terminal screw and dividing the arc quenching chamber from the line terminal chamber.

While specific embodiments of the present invention have been described in detail, it will be appreciated by those skilled in the art that various modifications and alternatives to those details could be developed in light of the overall teachings of the disclosure. For example, the turbulator can be used in an electrical device which has less than or more than three poles, where the turbulator of the present invention is installed in each pole, or the device can be any device which has electrical contacts which form an arc upon their separation and where protection of a terminal is required. Accordingly, the particular arrangements disclosed are meant to be illustrative only and not limiting as to the scope of the invention which is to be given the full breadth of the appended claims and any and all equivalents thereof.

What is claimed is:

1. In an electrical device for automatically interrupting an overload current comprising:

an electrically insulating housing having an opening, and a compartment and including terminal means within said compartment;

a circuit breaker mechanism in said compartment and having a pair of cooperable contacts operable between an open position and a closed position, the closed position of said contacts forming an electric circuit with said terminal means, said open position of said contacts causing arcing there between and the development of ionized gases; and electrically insulating turbulator means within said compartment and including an arcuate portion extending around the terminal means, said arcuate portion having fin means located in the path of said ionized gases to create a turbulent flow of said ionized gases and to direct said ionized gases in a desired direction around said terminal means and out of the opening of said housing.

2. In a device of claim 1, said turbulator means further comprising:

downturned flange means disposed between said terminal means and said contacts for at least preventing arc flashover between said terminal means and said contacts during said arcing upon the opening of said contacts.

3. In a device of claim 2, said turbulator means further comprising:

a first planar portion extending across said compartment and around said arcuate portion of said turbulator means.

4. In a device of claim 3, wherein said turbulator means further comprises spaced apart second and third planar portions and spaced from said first planar portion.

5. In a device of claim 4, wherein said fin means consists of a plurality of fins, and wherein said plurality of fins is staggered relative to said first, second, and third planar portions.

6. In a device of claim 4, wherein said second and third planar portions each have an arcuate recess extending around said arcuate portion of said turbulator means.

7. In a device of claim 4, wherein said first, second and third planar portions each have angled end surfaces cooperating with said fin means of said arcuate portion.

8. In a device of claim 1, wherein said arcuate portion of said turbulator means includes a blowout membrane, said blowout membrane having a wall thickness less than the overall thickness of said arcuate portion.

9. In a device of claim 1, wherein said turbulator means is made of a deionizing material in order to lessen the pressure of said ionized gases.

10. In a device of claim 1, wherein said terminal means includes a plurality of terminals and wherein said turbulator means is provided for each of said terminals.

11. In a device of claim 1, wherein said device is a circuit breaker.

12. In a device of claim 1, wherein said device is a motor circuit protector.

13. In an electrical device for automatically interrupting an overload current comprising:

an electrically insulating housing having an opening, and a compartment and including terminal means within said compartment;

a circuit breaker mechanism in said compartment and having a pair of cooperable contacts operable between an open position and a closed position, the closed position of said contacts forming an electric circuit with said terminal means, said open position of said contacts causing arcing there between and the development of ionized gases; and electrically insulating turbulator means within said compartment and including an arcuate portion extending around the terminal means, said arcuate portion having fin means located in the path of said ionized gases to create a turbulent flow of said ionized gases and to direct said ionized gases in a desired direction around said terminal means and out of the opening of said housing, said turbulator means further including downturned flange means disposed between said terminal means and said contacts for at least preventing arc flashover between said terminal means and said contacts during said arcing upon the opening of said contacts.

14. In a device of claim 13, said turbulator means further comprising:

a first planar portion extending across said compartment and around said arcuate portion of said turbulator means.

15. In a device of claim 14, wherein said turbulator means further comprises spaced apart second and third planar portions and spaced from said first planar portion.

16. In a device of claim 15, wherein said fin means consists of a plurality of fins, and wherein said plurality of fins is staggered relative to said first, second, and third planar portions.

17. In a device of claim 15, wherein said second and third planar portions each have an arcuate recess extending around said arcuate portion of said turbulator means.

18. In a device of claim 15, wherein said first, second and third planar portions each have angled end surfaces cooperating with said fin means of said arcuate portion.

19. In an electrical device for automatically interrupting an overload current comprising:

an electrically insulating housing having an opening, and a compartment and including terminal means within said compartment;

a circuit breaker mechanism in said compartment and having a pair of cooperable contacts operable between an open position and a closed position, the closed position of said contacts forming an electric circuit with said terminal means, said open position of said contacts causing arcing there between and the development of ionized gases; and electrically insulating turbulator means within said compartment and including an arcuate portion extending around the terminal means, said arcuate portion having fin means located in the path of said ionized gases to create a turbulent flow of said ionized gases and to direct said ionized gases in a desired direction around said terminal means and out of the opening of said housing, said arcuate portion including a blowout membrane, said blowout membrane having a wall thickness less than the overall thickness of said arcuate portion.

20. In a device of claim 19, wherein said turbulator means is made of a deionizing material in order to lessen the pressure of said ionized gases.

* * * * *